United States Patent [19]

Hofbauer et al.

[11] Patent Number: 4,690,118

[45] Date of Patent: Sep. 1, 1987

[54] DEVICE FOR CONTINUOUS FUEL INJECTION

[75] Inventors: Peter Hofbauer, Wolfsburg; Jürgen Sandhagen, Vordorf/Rethen, both of Fed. Rep. of Germany

[73] Assignee: Volkswagen Aktiengesellschaft, Wolfsburg, Fed. Rep. of Germany

[21] Appl. No.: 847,905

[22] PCT Filed: Jul. 8, 1985

[86] PCT No.: PCT/EP85/00334

§ 371 Date: Mar. 12, 1986

§ 102(e) Date: Mar. 12, 1986

[87] PCT Pub. No.: WO86/00669

PCT Pub. Date: Jan. 30, 1986

[30] Foreign Application Priority Data

Jul. 13, 1984 [DE] Fed. Rep. of Germany ..... 3425856

[51] Int. Cl.[4] ..... F02M 39/00

[52] U.S. Cl. ..... 123/533; 123/472

[58] Field of Search ..... 123/452, 472, 531, 533, 123/482

[56] References Cited

U.S. PATENT DOCUMENTS

| | | | |
|---|---|---|---|
| 1,977,200 | 10/1934 | Osterberg | 123/533 |
| 4,246,879 | 1/1981 | Fiala | 123/533 |
| 4,363,308 | 12/1982 | Emmenthal | 123/533 |
| 4,543,939 | 10/1985 | Ehrhart | 123/533 |
| 4,556,037 | 12/1985 | Wisdom | 123/533 |

FOREIGN PATENT DOCUMENTS

| | | | |
|---|---|---|---|
| 163198 | 12/1985 | European Pat. Off. | 123/533 |
| 3,102,266 | 8/1982 | Fed. Rep. of Germany | 123/533 |
| 56-41452 | 4/1981 | Japan | 123/472 |

*Primary Examiner*—Ronald B. Cox

*Attorney, Agent, or Firm*—Brumbaugh, Graves, Donohue & Raymond

[57] ABSTRACT

A device for continuous injection of fuel into the intake line of a multi-cylinder mixture-compressing internal combustion engine is described, the said engine comprising an air pump (9) delivering a carrier air current branched off the intake line (2) and a fuel pump (4) which delivers the fuel from a fuel tank (3) to a metering device (7), apportioning the fuel to the carrier air current as a function of the operating state of the internal combustion engine. In order to ensure the best possible uniform and precise metering of the fuel of the fuel to the individual cylinders of the internal combustion engine, means for dividing the carrier air current among the carrier air injection lines (29) separately associated with the individual cylinders of the internal combustion engine are to be provided. Furthermore, the metering device is to be constituted by an injection valve (7) with injection lines (1) (36) each separately associated with the carrier air injection lines (29) and opening into the same (FIG. 1).

6 Claims, 2 Drawing Figures

DEVICE FOR CONTINUOUS FUEL INJECTION

Figure 1:
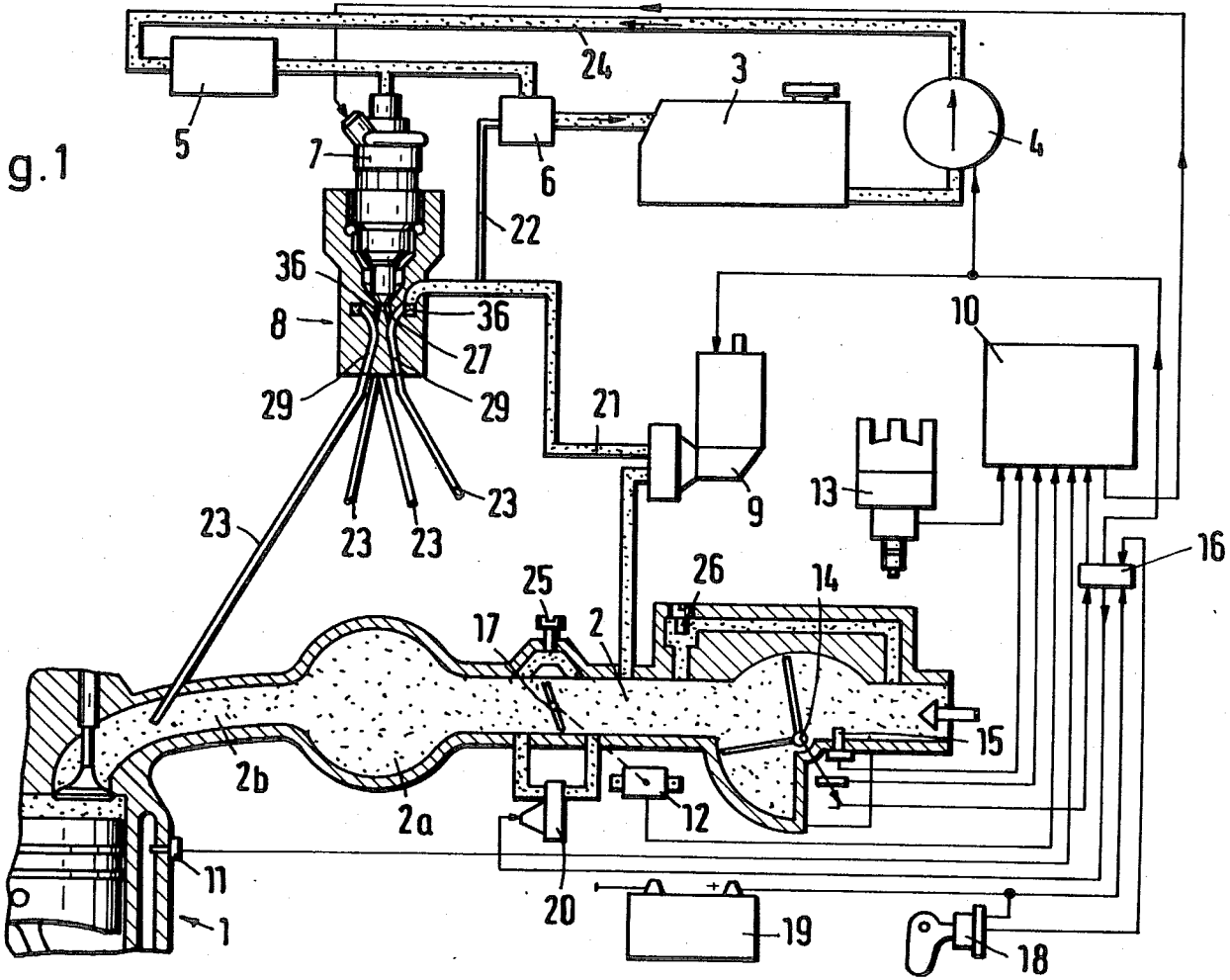

The invention concerns a device for continuous fuel injection into the intake line of a multi-cylinder, mixture-compressing internal combustion engine in accordance with the definition of the species in claim 1.

In case of such fuel injection devices, known, e.g., from German DE-OS Nos. 29 20 636 and 32 22 000, the fuel is metered by means of an injection nozzle controlled by a control means into a carrier air current, branched off the intake line, before the mixture of fuel and supporting air formed in this manner and subsequently distributed to the individual cylinders of the internal combustion engine is injected into the intake line of the internal combustion engine, namely, the intake manifolds associated with the individual cylinders of the internal combustion engine, a short distance ahead of the intake valves thereof. The advantage of such an injection device consists in that for injection of the fuel-air mixture under pressure into the intake manifolds, no injection nozzles such as utilized in customary fuel injection devices are necessary inasmuch as the mixture under pressure, even if in small quantities, expands on entering the intake manifolds and thereby is finely divided and sprayed. This favorable [fuel] preparation effect is further enhanced by the partial fuel evaporation which occurs on expansion of the fuel-air mixture.

In these known fuel injection devices, difficulties occur which are due to the fact that the fuel-air mixture, formed by injection of the fuel into the carrier air current through a center fuel injection nozzle, prior to delivery into the individual intake manifolds must be divided among the individual cylinders. Thereby a special problem occurs because the mixture to be divided is a two-phase mixture composed of a liquid fuel and gaseous air which, for the purpose of combustion with a high efficiency and low in exhaust gases, must be divided in the cylinders of the internal combustion engine as uniformly and as precisely as possible, particularly in view of the liquid phase.

Therefore, the purpose of the invention is to provide of the kind indicated a fuel injection device fo the kind indicated whereby the problems of a uniform allotment of the fuel to the individual cylinders of the internal combustion engine are solved in a simple, low-cost manner.

This purpose is attained by providing the fuel injection device with means for dividing the carrier air current among carrier air injection lines separately associated with the individual cylinders of the internal combustion engine and a metering device comprising an injection valve having injection openings each individually associated with and opening into the carrier air injection lines.

Further suitable refinements of the invention include injection lines which branch off at equal intervals along the circumference of an air carrier reservoir, and are connected to a pressure side of an air pump. Furthermore, each of the injection openings is aligned toward a downstream end of the injection lines, the openings opening into zones of the carrier injection lines whose cross-sections are restricted in a nozzle-like fashion.

The drawing represents an example of an embodiment of the invention which will be explained in detail in the following.

Figure 2:
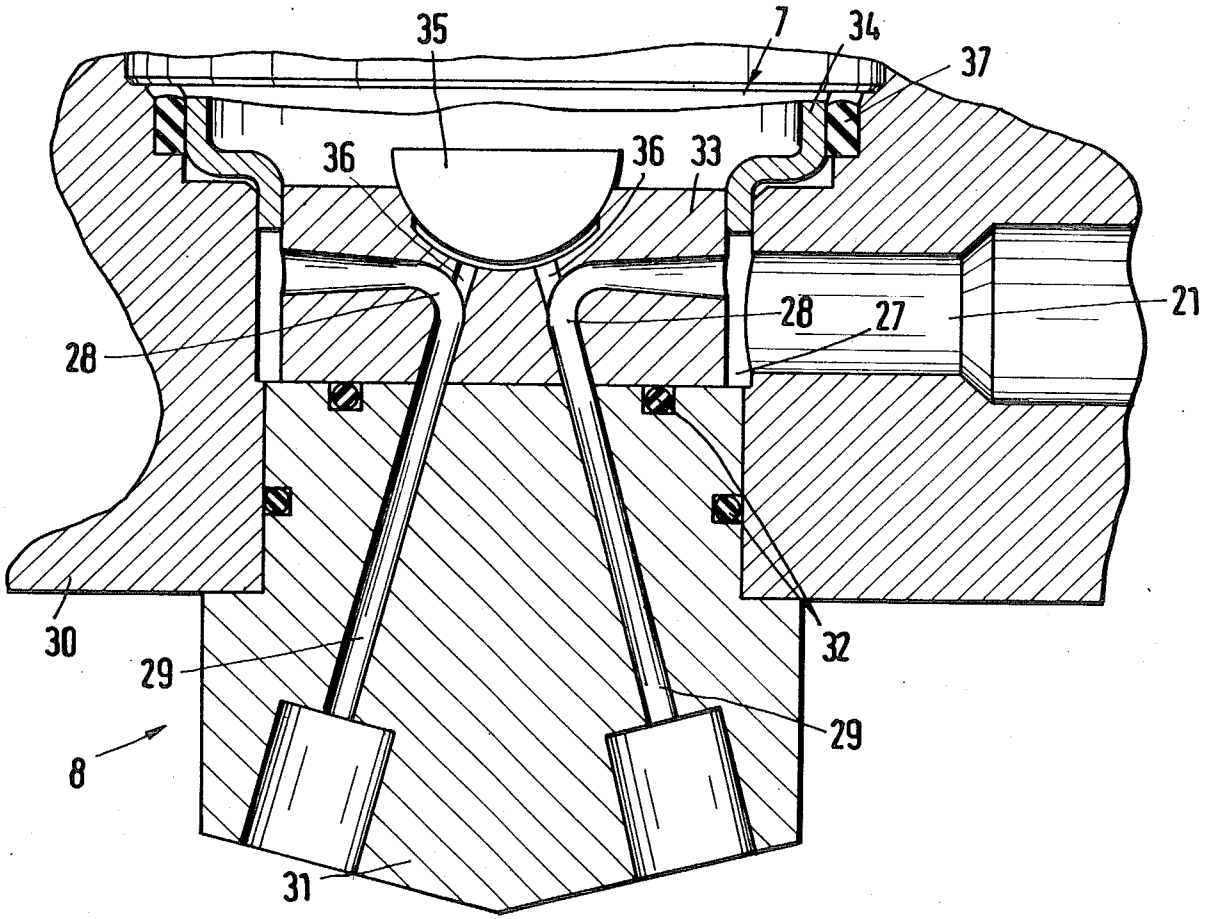

FIG. 1 is a schematic circuit diagram of a fuel injectin device according to the invention, and FIG. 2, is a representation of the dosing device on an enlarged scale.

In the circuit diagram of the fuel injection device shown in FIG. 1, -1- designates a part of a customary mixture-compressing combustion engine and -2- an intake line system leading to the said combustion engine, which system is provided with an intake distributor **-2*a*- and a number of intake manifolds -2*b*-associated with the individual cylinders of the combustion engine -1-**.

-9- designates an air pump and -4- a fuel pump which may be driven either separately or combined so as to form an assembly by use of a common driving motor constituted, e.g., by an electric motor, associated with the two pumps.

The fuel pump -4- sucks in fuel from a fuel tank -3- and delivers said fuel by way of a fuel line -24- in which is arranged a filter -5- to a fuel metering device constituted by an injection valve -7- which, in accordance with the signals of a control means -10-, delivers a fuel quantity associated with the operating condition of the combustion engine at the time. In a mixture-forming and dividing device -8- the fuel is injected into a carrier air current which by way of a line -21- is delivered by the air pump -9- which on the suction side is connected with the intake line system -2- of the combustion engine -1-. The carrier air current employed to deliver the fuel metered through the injection valve -7- into the cylinders of the combustion engine thus is branched off the air current sucked in by the combustion engine.

Fuel metering is obtained in each case separately into partial carrier air currents previously divided for the individual cylinders of the combustion engine and subsequently transported by way of individual injection lines -23- to the intake manifolds **-2*b*- associated in each case with the cylinders of the combustion engine -1-. The mixture delivered through the injection lines -23-** is finally injected continuously in the vicinity of the intake valves of the combustion engine and, with the intake valves open, is forwarded together with the main air current into the combustion chambers.

In FIG. 1 of the drawing, -22- designates a branch line branching off the pressure-side delivery air line -21- the said branch line connected with a fuel pressure regulator -6- determining the pressure in the fuel line -24-. The fuel pressure regulator conducts the excess fuel via a return line into the fuel tank -3-.

The control means designated by -10- controls the injection valve -7- effecting the fuel metering, among others as a function of the air quantity sucked in by the combustion engine -1-, towards which end is provided in the intake line system -2- an air quantity meter designated by -14-, and also as a function of the temperature and the speed of the combustion engine, towards which end are present corresponding sensors in the form of a temperature sensor -11- arranged on the cylinder block -1- of the internal combustion engine and an ignition distributor designated by -13-.

A sensor determining the intake air temperature is provided as indicated by -15-. It is likewise connected with the control means 10 for the purpose of signal delivery as is a throttle valve switch -12- for detecting the position of the throttle valve -17-.

Furthermore, -20- designates an auxiliary air valve arranged in the intake line system -2-, which valve serves the correction of the air quantity, delivered in particular during warming-up, and bypasses the throttle valve designated by -17-, whereas -25- represents an idling speed adjustment screw and -26- an idling mixture adjustment screw. Finally, -18- designates an ignition-starting switch and -19- a battery for electric current supply which may be constituted, e.g., by the customary electric system battery of the vehicle, while -16- designates a relay combination by means of which, on actuation of the ignition-starting switch -18- the fuel pump -4- and the air pump -9- are connected.

In FIG. 2 there is represented on an enlarged scale the mixture forming and dividing device -8-, with an injection valve -7- which, rather than injecting the fuel centrally into one carrier air line -23- common to all injection lines, injects the fuel into individual carrier air injection lines -29-, each connected with an injection line -23-, and in each case associated with a cylinder of the combustion engine.

From the example of an embodiment shown in FIG. 2, it furthermore becomes apparent that the injection valve -7- is provided with a head part -33- with a valve body -35- actuable, e.g. by electromagnetic means, not shown here, and held in a valve housing -34-. In the head part -33- of the injection valve -7- are incorporated here the carrier air injection lines -29- leading separately to the individual cylinders as well as injection openings -36- associated with the said carrier air injection lines and opening into them, by way of which injection openings the fuel is delivered in quantities associated in each case with the individual cylinders.

The injection openings -36- can open into the carrier air injection lines -29- in points in which said lines are provided with nozzle-like constrictions 28. The delivery of the fuel at such constricted cross sections of the carrier air lines offers the advantage that, as a result of the larger air flow velocity occurring at such a point, the pressure level required for injection of the fuel and to be provided by the fuel pump can be reduced (injector effect).

Furthermore, it is of advantage to align the injection openings -36- in such a manner that they inject the fuel in the direction of the air flow, i.e., in the direction towards the downstream ends of the carrier air injection lines -29-. In this manner, a more rapid fuel transport is ensured even at unfavorable operating conditions and it can be prevented that the fuel flows back in opposition to the air flow direction into the carrier air reservoir where it can cause a non-uniform fuel distribution in the individual cylinders.

In FIG. 2 of the drawing, -30- and -31- show separate housing components of the mixture forming and dividing device -8- which, with interposition of sealing rings -32- and -37- are connected with each other and, respectively, the injection valve -7-.

In comparison with prior known fuel injection devices, the essential advantage of the present invention consists in that the fuel is not delivered centrally into the carrier air and subsequently a distribution of the carrier air-fuel mixture to the individual cylinders is obtained but rather, the carrier air is initially divided among the individual cylinders and subsequently, the fuel, likewise apportioned separately to the individual cylinders of the combustion engine, is delivered to the partial carrier air currents through a single injection valve with a number of injection openings corresponding to the number of cylinders. Inasmuch as the separate division of the individual phases, namely the gaseous phase of the carrier air and the liquid phase of the fuel, can be obtained with substantially fewer problems than the division of a two-phase flow required after mixing, the fuel metering in the latter case is achieved with substantially more precision and uniformity. Of course, it becomes necessary that the injection openings of the injection valve can be rendered precisely so that from them are delivered equal quantities of fuel in each case. On the other hand, the division of the carrier air among the individual phases is less critical since small differences in the quantities apportioned will not result in any serious effects on the operational behavior of the combustion engine.

We claim:

1. Device for continuous injection of fuel into the intake lines of a multi-cylinder mixture-compressing internal combustion engine, with an air pump delivering a carrier air current branched off the intake line and with a fuel pump which delivers the fuel from a fuel tank to a metering device which apportions the fuel to the carrier air current as a function of the operating state of the internal combustion engine, the device comprising means for division of the carrier air current among carrier air injection lines separately associated with the individual cylinders of the internal combustion engine, the metering device being provided as an injection valve having a head part and a valve body which is adjustable relative to said head part so as to deliver the fuel through separate injection openings provided in said injection valve so as to be individually associated with and opening into the carrier air injection lines said head part of the injection valve being provided with an annular carrier air reservoir which surrounds the injection valve concentrically and is connected to the air pump, said carrier air injection lines being provided so as to individually branch off the carrier air reservoir at uniform intervals over the circumference of said reservoir.

2. Device for continuous injection of fuel into an intake line of a multi-cylinder mixture-compressing internal combustion engine, with an air pump delivering a carrier air current branched off said intake line and with a fuel pump which delivers the fuel from a fuel tank to a metering device apportioning the fuel to the carrier air current as a function of the operating state of the internal combustion engine, characterized in that means are provided for division of the carrier air current among carrier air injection lines separately associated with the individual cylinders of the internal combustion engine and in that the metering device comprises an injection valve having injection openings each individually associated with the carrier air injection lines and opening into zones of the carrier air injection lines whose cross sections are constricted in a nozzle-like fashion.

3. Injection device as defined in claim 1, wherein each of the injection openings (36) of the injection valve (7) are aligned towards a downstream-end of each of the carrier air injection lines.

4. Injection device as defined in claim 1, wherein the carrier air injection lines are provided with zones having cross-sections constricted in a nozzle-like manner, each of the injection openings of the injection valve being provided so as to open into one of the zones of contricted cross-section.

5. The device of claim 2, wherein a carrier air reservoir connected to a pressure side of the air pump is provided from which reservoir branch off a number of air injection lines corresponding to the number of cylinders of the internal combustion engine.

6. The device of claim 5, wherein said carrier air injection lines branch off regularly over the circumference of the carrier air reservoir.

* * * * *

UNITED STATES PATENT AND TRADEMARK OFFICE

CERTIFICATE OF CORRECTION

PATENT NO. : 4,690,118

DATED : September 1, 1987

INVENTOR(S) : Hofbauer et al.

It is certified that error appears in the above-identified patent and that said Letters Patent is hereby corrected as shown below:

First page, Item [56], References Cited, Col. 1, under "4,543,939 10/1985 Ehrhart ..... 123/533" insert --4,519,370 5/1985 Iwata ..... 123/533--;

First page, Item [56] Foreign Patent Documents, Col. 2, under "56-41452 4/1981 Japan ..... 123/472" insert --12316 8/1910 France ..... 123/533; 1,456,347 10/66 France; 3,14252 9/1919 Fed. Rep. of Germany ..... 123/533; 2,900,691 7/1980 Fed. Rep. of Germany ..... 123/533--.

Signed and Sealed this

Seventeenth Day of May, 1988

*Attest:*

*Attesting Officer*

DONALD J. QUIGG

*Commissioner of Patents and Trademarks*